United States Patent [19]

Lindner

[11] 4,216,256

[45] Aug. 5, 1980

[54] REVERSIBLE BASKET LINER

[76] Inventor: Renate G. Lindner, 1569 Central Ave., Windsor, Ontario, Canada, N8Y 3V7

[21] Appl. No.: 948,784

[22] Filed: Oct. 5, 1978

[30] Foreign Application Priority Data

Oct. 25, 1977 [CA] Canada ..... 289474

[51] Int. Cl.[2] ..... B32B 3/02; A45C 11/20

[52] U.S. Cl. ..... 428/66; D6/271; D7/29; D7/76; D9/247; 220/403; 150/50

[58] Field of Search ..... 428/64, 66; 220/403, 220/404; D6/271, 272; D7/29, 76; D9/246, 247

[56] References Cited

U.S. PATENT DOCUMENTS

| | | | |
|---|---|---|---|
| D. 81,288 | 6/1930 | Jones | D6/271 |
| D. 87,362 | 7/1932 | Sherman | D9/249 |
| D. 89,896 | 5/1933 | Karfiol | D6/272 |
| D. 122,489 | 9/1940 | Marghab | D6/271 |
| D. 162,310 | 3/1951 | Karfiol | D6/272 |
| D. 169,070 | 3/1953 | Katz | D7/76 |
| D. 171,114 | 12/1953 | Warren | D7/76 |
| D. 189,119 | 10/1960 | Loui et al. | D6/272 |
| 1,142,330 | 6/1915 | Lahière | 428/64 |
| 1,164,962 | 12/1915 | Sayford | 220/403 |
| 1,213,194 | 1/1917 | Hill | 220/403 |
| 2,546,874 | 3/1951 | Siegrist | 428/66 |
| 2,610,111 | 9/1952 | Stanley | 428/66 |
| 2,790,573 | 4/1957 | Warren | 220/404 |

*Primary Examiner*—William R. Dixon, Jr.

*Attorney, Agent, or Firm*—Pearne, Gordon, Sessions, McCoy & Granger

[57] ABSTRACT

This invention consists of a liner for bread baskets. It is made of a partly stiff cloth, circular in shape, and having an extra stiffened circular base of the same material in the center thereof. This base is of a much smaller diameter than the liner. The perimeters of the liner and its base are trimmed with various edge trimmings, and the cloth used is woven or imprinted with colorful decorative designs.

2 Claims, 3 Drawing Figures

REVERSIBLE BASKET LINER

BACKGROUND OF THE INVENTION

This invention relates generally to inserts used in lining the insides of bread baskets, and particularly to such liners which are washable, reversible, and decorative.

In almost every case, where a table is set for dinner, one of the main items on that table is a wicker-type of basket for containing therein sliced bread, buns, or other small bread items. It has been standard practice to line the basket with some form of napkin before placing the bread therein. Although napkin liners add a neat and clean appearance to the basket, not being designed for that purpose, they do not add any decorative value to the basket nor the table upon which the basket is set, and actually they distract from the decorative design of the wicker basket because of the limp overhanging corners of the napkin.

SUMMARY OF THE INVENTION

It is therefore the main object of this invention to provide a liner for bread baskets which is specifically designed for that purpose; one which will improve the appearance of the basket; and will thereby enhance the general good looks of the set table.

This is accomplished in the invention by providing a liner which is circular in shape so that it can fit uniformally in a circular or square basket within the usual range of sizes in which these baskets are made; it is made of a cloth which has the right degree of stiffness to provide pleasant, well formed folds around the perimeter of the basket; it is reversible; and easily machine washable. The cloth used can have various colorful designs imprinted or woven into it to provide additional beauty to the basket.

BRIEF DESCRIPTION OF THE DRAWINGS

In describing the invention, reference will be made to the attached drawings in which.

DESCRIPTION OF THE PREFERRED EMBODIMENT

Figure 1:
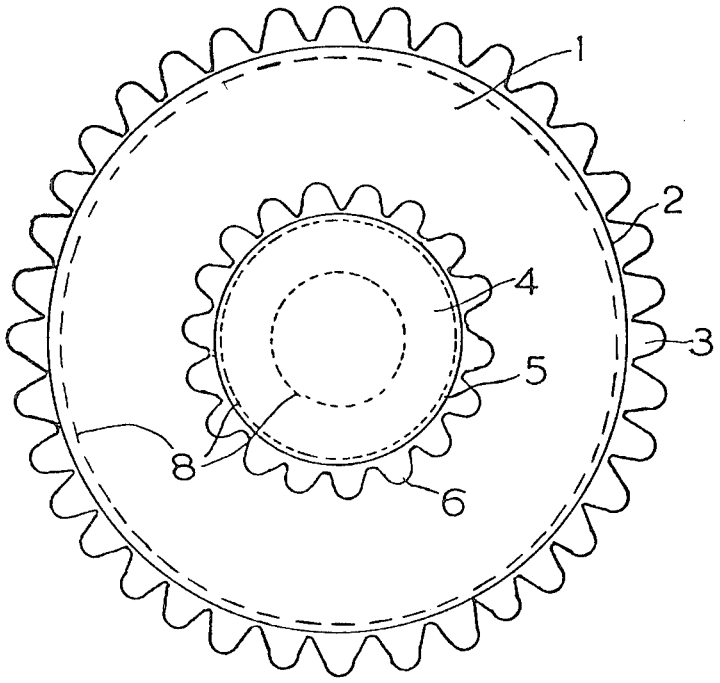
FIG. 1 is a plan view of a basket liner embodying the invention.

In the drawings, the liner 1 is shown consisting of two identical circular pieces of cloth 2 of a partly stiff material, such as canvas, cotton or linen cotton, preferably decorated with some attractive colorful design. Sandwiched between the edges and stitched together with 2, as shown in FIG. 2, by stitches 8 is a decorative edge trimming 3, which, by way of example, is the trimming known as "rick-rack".

Centrally located on the liner 1 is a circular base which consists of a circular cloth 5 of smaller diameter than the cloth piece 2, but of the same material. The piece of cloth 5 is also trimmed around its edge with a decorative edging which may be similar to the edging 3.

Figure 2:
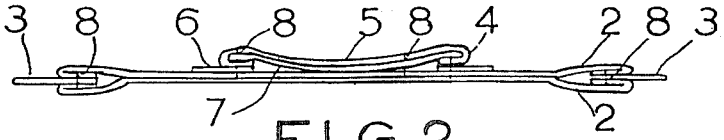
FIG. 2 is a diagrammatic section through the center of the basket liner of FIG. 1.

The center base 4 is also provided with an additional stiffener 7, and the cloth 5, the stiffener 7, the trimming 6, and the two pieces of cloth 2,2, are all stitched together as can be seen in FIG. 2.

Figure 3:
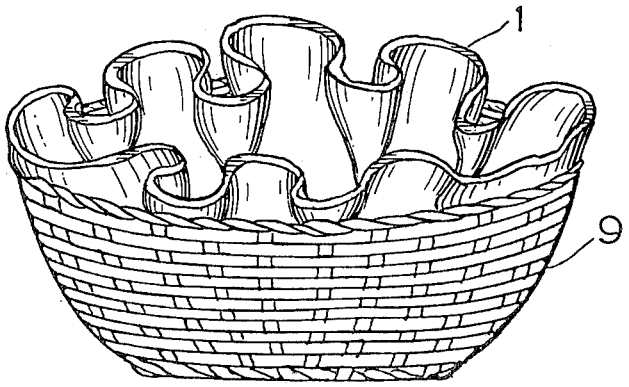
FIG. 3 is an isometric view of a basket with the liner located therein.

In FIG. 3, the liner 1 is shown inserted into the basket 9. The particular natural stiffness of the material 2 used in making the liner 1, in combination with the extra stiffened base 4, creates a beautiful array of pleasant folds above and around the rim of the basket 9, and it also helps to retain the liner within the basket.

In the drawing, the view shown in FIG. 3, it has been found that the rick-rack trimming obsured the graceful folds, and was therefore omitted from the view.

In describing the invention, the actual cloth used in fabricating the invention has been named. After considerable experimentation with a large variety of materials, the cloth used has been found to have the most desirable characteristics. However, it is thereby not intended to limit the scope of this invention to these materials only, since, due to the rapid growth of present day technology, other material having such characteristics may be offered upon the market in the near future, and these may be used to replace the materials named above.

It is also important to indicate that due to the particular construction of this liner, as described above, it fits well into any shaped bread basket presently available. This is considered a very important feature because of the great variety of baskets now being sold.

While the device of the invention has been shown and described with respect to a specific embodiment thereof, other modifications and variations of the specific device herein shown and described will be readily apparent to those skilled in the art and other modifications and variations of the specific device herein shown and described may be used without departing from the spirit and scope of the invention. Accordingly, the patent is not to be limited in scope and effect to the specific device herein shown and described, nor in any other way that is inconsistent with the extent to which the progress in the art has been advances by the invention.

I claim:

1. A liner for bread baskets comprising:

a pair of circular sections of relatively stiff fabric material stitched together back-to-back at their edges to form two reversible faces for said liner;

an ornamental trim tape outlining and attached to the rim of said liner by the stitching between said circular sections;

a centrally located circular patch formed of the same general type of material as said sections and having a diameter smaller than the diameter of said sections, said circular patch being stitched to one of said faces of said liner;

an additional stiffening element of flat, circular shape and formed of relatively stiff stitchable material, located in and filling said patch, said stiffening element being held in said patch by a plurality of concentric circular paths of stiching; and an ornamental trim tape attached to and outlining the rim of said patch, said patch forming a sfiff central base for said liner when it is inserted into a bread basket.

2. A liner, such as described in claim 1, in which the cloth consists of material selected from the group consisting of canvas, cotton, and linen cotton.

* * * * *